United States Patent [19]

Patterson, III et al.

[11] 4,096,816

[45] Jun. 27, 1978

[54] CONTAINER LASH SYSTEMS

[76] Inventors: W. W. Patterson, III, Witherow Rd., Sewickley, Pa. 15143; Eugene F. Grapes, 1106 Eighth Ave., Irwin, Pa. 15642

[21] Appl. No.: 794,670

[22] Filed: May 6, 1977

Related U.S. Application Data

[62] Division of Ser. No. 611,200, Sep. 8, 1975, Pat. No. 4,048,938.

[51] Int. Cl.[2] ..... B63B 25/08

[52] U.S. Cl. ..... 114/75; 248/500; 403/353

[58] Field of Search ..... 114/73, 75; 9/46; 214/10.5 R; 105/463–464, 466, 469, 471, 472, 473–474, 477, 478, 479, 480, 485–488, 366 E, 368 T, 497; 24/81 E, 221 RC; 248/499, 500; 220/1.5; 403/43–45, 90, 56, 76, 93, 94, 122, 231, 353, 360, 375

[56] References Cited

U.S. PATENT DOCUMENTS

| | | | |
|---|---|---|---|
| 141,191 | 7/1873 | Wilson | 403/43 |
| 1,635,860 | 7/1927 | Overman | 9/46 |
| 1,653,092 | 12/1927 | Draper | 403/353 |
| 3,102,743 | 9/1963 | Niskin | 403/44 |
| 3,606,704 | 9/1971 | Denton | 403/43 |
| 3,719,377 | 3/1973 | Schultz et al. | 403/44 |
| 3,776,169 | 12/1973 | Strecker | 114/75 |

FOREIGN PATENT DOCUMENTS

| | | | |
|---|---|---|---|
| 1,365,720 | 9/1974 | United Kingdom | 403/353 |

*Primary Examiner*—Trygve M. Blix
*Assistant Examiner*—Jesus D. Sotelo
*Attorney, Agent, or Firm*—Buell, Blenko & Ziesenheim

[57] ABSTRACT

A container lashing system for fastening shipboard containers is provided having a rigid elongated lashing bar with at least one generally ball shaped end and at least one securing fitting having a corresponding generally ball shaped socket with a keyhole shaped opening admitting the ball shaped end and adjacent portion of lashing bar into the socket for securing the end in the socket.

3 Claims, 7 Drawing Figures

Fig. 2.
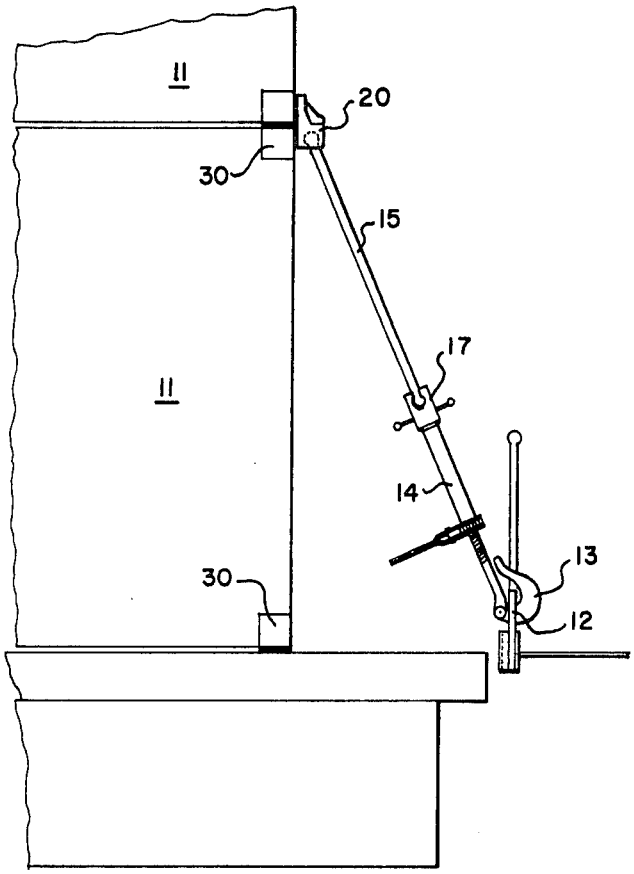
Fig. 3.
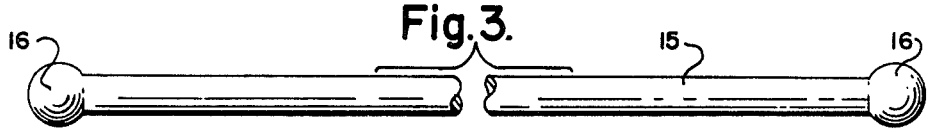
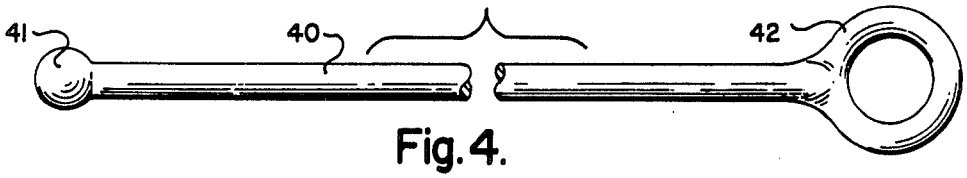
Fig. 4.

CONTAINER LASH SYSTEMS

This application is a division of our co-pending application Ser. No. 611,200, filed Sept. 8, 1975 now U.S. Pat. No. 4,048,938 issued Sept. 30, 1977.

This invention relates to container lash systems and particularly to a system for lashing containers on ships in container service fitted with securing lugs.

The use of containers in marine transportation has become an accepted method of handling goods in shipment. These containers come in basic modules which are stacked in multiple high layers both in the hold of the ship and on the deck. In order to prevent the containers from shifting in the hold or on deck, they have been lashed in place with wire cables and turnbuckles. The use of wire rope or cables is, however, fraught with problems. First, the cables tend to fray permitting sharp spikes of wire to stick out from the surface to catch and cut the unwary. Second, the wire rope or cable is too flexible to permit it being held up and attached to a hook on the top container. This requires that a man climb up to the top container in order to attach an end to the container. This is time consuming and involves an unnecessary element of danger. Both of these reasons have resulted in a great deal of labor problems with stevedores and ship's crew.

We have invented an entirely new lashing system which eliminates all of these problems and provides a system which can be quickly and positively installed.

We provide a rigid elongated lashing bar having at least one generally ballshaped end and at least one securing fitting having a corresponding generally ball shaped socket having a keyhole shaped opening admitting the ball shaped end of said lashing bar. Said securing fitting may be a fixed fitting such as a corner casting or an adjustable fitting such as a turnbuckle. Preferably the lashing bar is provided with generally ball shaped ends at both ends and is fitted into a fixed fitting at one end and an adjustable fitting at the other end.

In the foregoing general description of this invention certain objects, purposes and advantages have been set out. Other objects, purposes and advantages of this invention will be apparent from a consideration of the following description and the accompanying drawings in which:

FIG. 2 is a fragmentary end elevational view of the container of FIG. 1 viewed from the left;

FIG. 3 is a side elevational view of a preferred form of lashing bar according to this invention;

FIG. 4 is a side elevational view of a second embodiment of lashing bar according to this invention;

Figure 1:
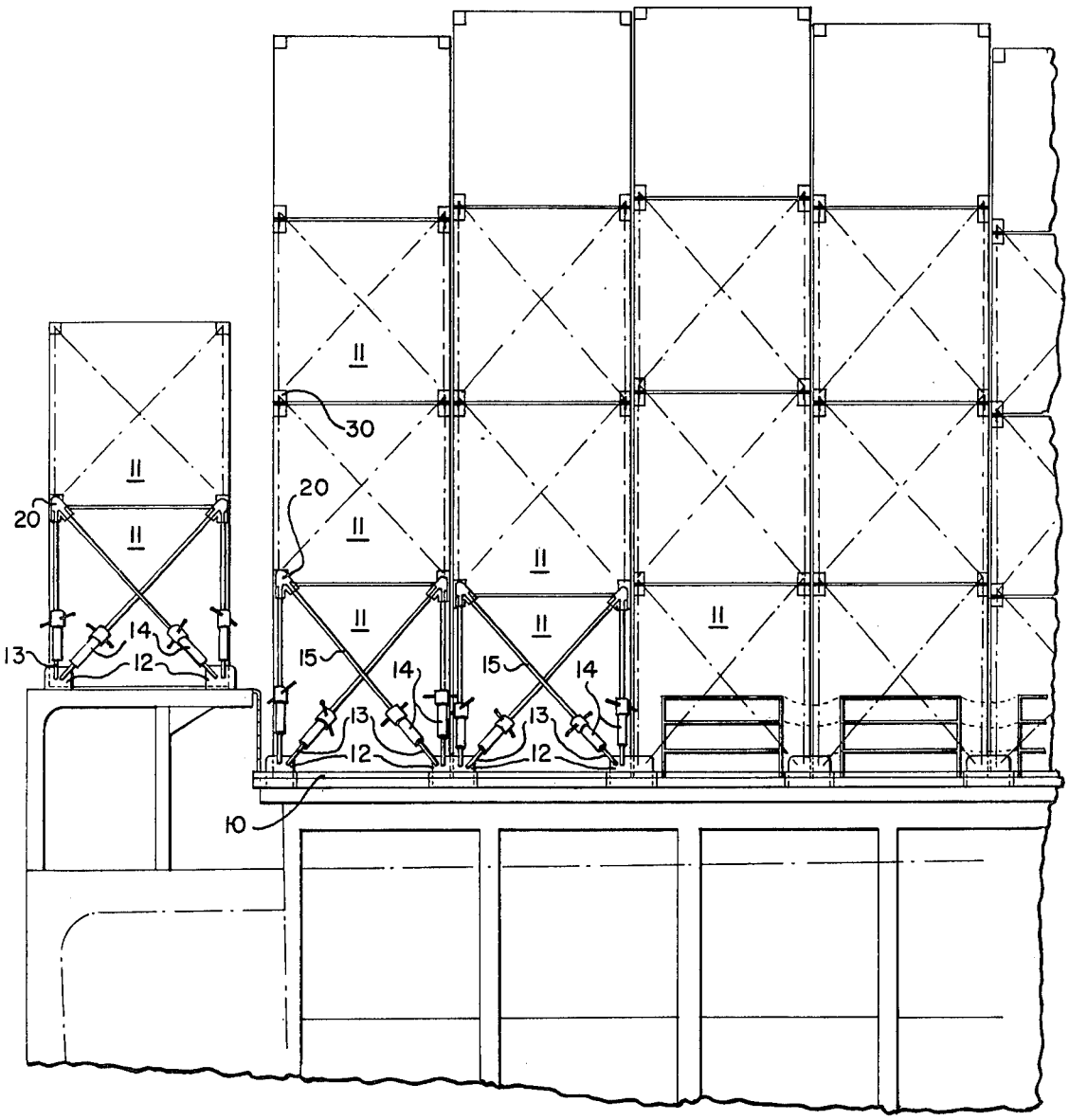
FIG. 1 is a fragmentary side elevational view of stacked containers on a ship showing the system of lashing according to this invention.
Figure 7:
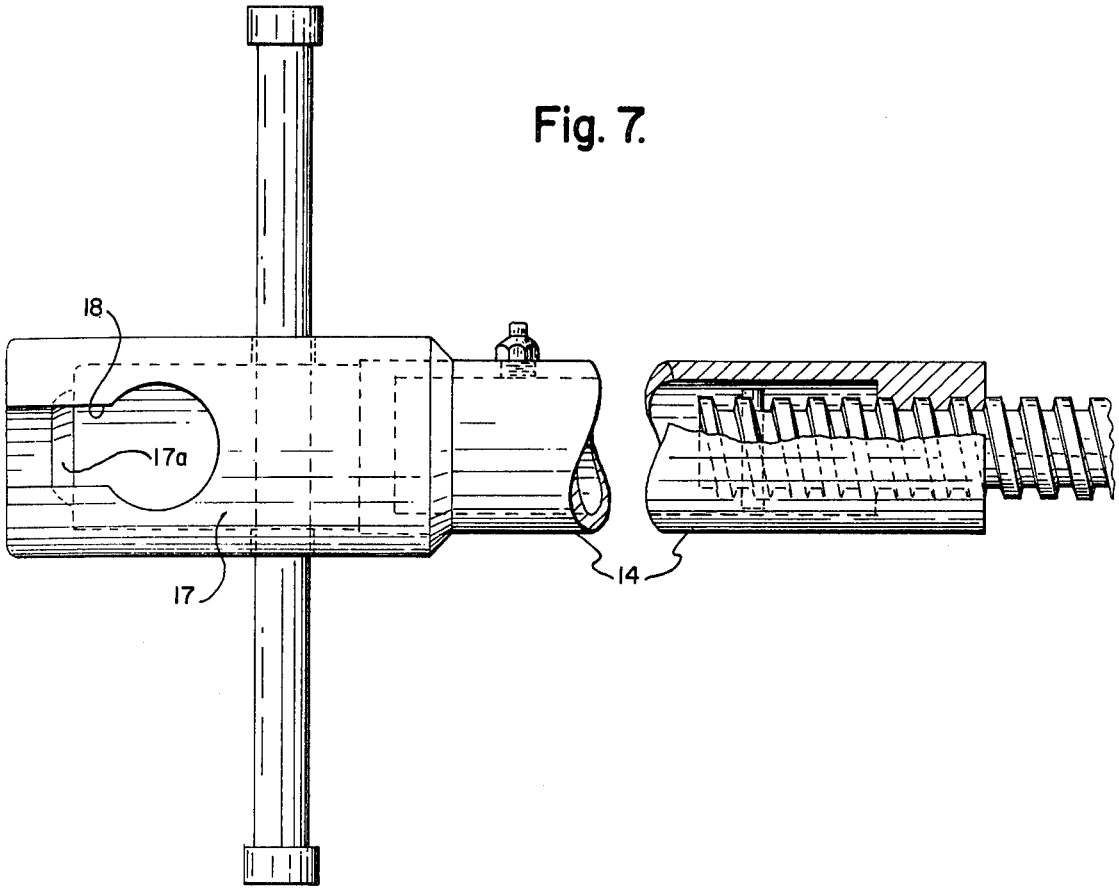
FIG. 7 is a side elevational view of a turnbuckle for use in this invention.
Figure 5:
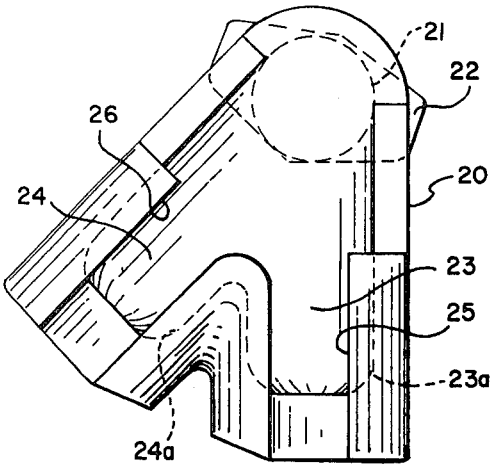
FIG. 5 is a side elevational view of a preferred form of corner casting used in this invention.
Figure 6:
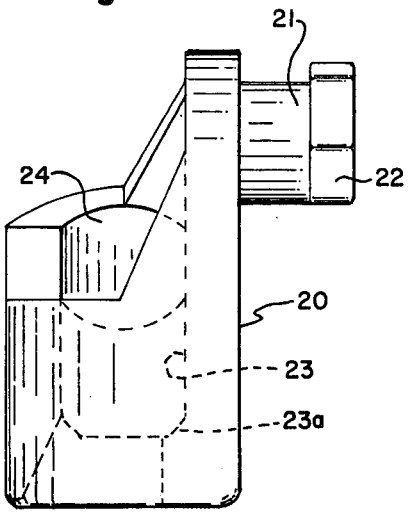
FIG. 6 is an end elevational view of the corner casting of FIG. 5 taken from the right.

Referring to the drawings, we have illustrated a typical ship deck 10 having containers 11 stacked in multiple layers. The deck is provided with securing lugs 12 at regular intervals adapted to receive a hook 13 on the end of turnbuckle 14. A solid steel lashing bar 15 is provided having ball ends 16 at each end. The turnbuckle 14 is provided, at the end opposite hook 13, with a ball socket 17 having a keyhole shaped opening 18 into the socket to receive the ball end 16 and bar 15. The turnbuckle receives ball end 16 into socket base **17*a*. A corner fitting 20 having the conventional shaft 21 and locking cam 22 on one side is provided on the opposite side with at least one and preferably two sockets 23 and 24 at an angle of 45° to one another. Each of these sockets has a keyhole shaped opening 25 and 26 respectively adapted to receive the ball 16 and bar 15 of the lashing bar end opposite the turnbuckle. Each socket has a base 23*a* and 24*a* respectively into which the ball 16 seats. Each socket is arranged so that the bar 15 can be moved out of the vertical away from the container at an angle up to 25° so that adjustments in the bar can be made for attaching the bar in a straight line to the securing lugs 12**.

In use the corner casting 20 is inserted into the hole of the casting receptacle 30 by rotating the casting 90° to insert the locking cam and shaft into the hole therein. This is all conventional and is not illustrated in detail. The casting 20 is then rotated back to put cam 22 in locking position, lashing bars 15 and balls 16 are then inserted in sockets 23 and 24 and positioned on socket bases **23*a* and 24*a*. The opposite end balls 16 are inserted in sockets 17 of a pair of turnbuckles 14 whose hook ends 13 are attached in securing lugs 12. The turnbuckles are then tightened to the required degree of tension to hold the container in place. This is repeated at each corner as shown in FIG. 1** of each container to fasten them to the deck so that they do not shift as the ship moves.

In FIG. 4 we have shown an alternative form of lashing bar 40 in which a ball 41 is provided at one end and an eye 42 is provided at the other end. This form of bar can be used with either a fixed fitting such as casting 20 or an adjustable fitting such as turnbuckle 14 at the one end having a ball 41. The eye 42 can then be applied over any of the conventional fixed fittings such as a corner casting having a pelican hook, or an adjustable fitting such as a conventional turnbuckle having a hook instead of the socket here proposed.

It is obvious from the foregoing description that the lashing bar system of this invention makes it possible for a stevedore working on the deck to attach one of the lashing bars to a corner casting and the other end to a turnbuckle without any climbing and without the need for ladders and without danger of injury from frayed wire ends.

While we have illustrated and described certain presently preferred practices and embodiments of our invention in the foregoing specification, it will be understood that this invention may be otherwise embodied within the scope of the following claims.

We claim:

1. A container lashing system for fastening shipboard containers having an integral corner casting receptacle comprising in combination a rigid elongated lashing bar having at least one generally ball shaped end, at least one corner casting securing fitting having means for removably engaging said corner casting receptacle, said securing fitting having an enlarged inner hollow portion with at least one keyhole shaped opening to the exterior said keyhole opening having a first enlarged portion open to the exterior of said securing fitting adapted to pass said ball shaped end of the lashing bar into the hollow interior and an elongate narrow portion extending from one side of said first enlarged portion through the sidewall of said securing fitting receiving the portion of the lashing bar adjacent the ball end into said socket for securing said end in the socket with the elongate narrow portion holding the ball against removal from the securing fitting and means acting on the lashing to place it and the securing fitting under tension in the corner casting receptacle.

2. A container lashing system as claimed in claim 1 wherein both ends of said lashing bar are provided with generally ball shaped ends, one of said ball shaped ends fitting in the keyhole opening in the securing fitting and the other fitting in a ball socket on the end of a turnbuckle adapted to be fixed to a ship member.

3. A container lashing system for fastening shipboard containers comprising in combination a hollow corner casting on at least each shipboard container roof corner, a rigid elongate lashing bar having at least one generally ball shaped end, a keyhole slot in each corner casting opening into the hollow interior thereof and having an opening receiving said ball shaped end of the lashing bar and a slot receiving said bar adjacent the ball shaped end in sliding engagement and retaining the ball within the corner casting, and means acting on the lashing bar opposite the ball end to place said lashing bar under tension in the corner casting.

* * * * *